United States Patent [19]

Sachs

[11] Patent Number: 5,036,161

[45] Date of Patent: Jul. 30, 1991

[54] TOP SHIELD ARRANGEMENT FOR FILTER TRAPS

[76] Inventor: Isaac Sachs, 1240 Ridgewood Drive, Chomedey, Laval Quebec, Canada, H7W 1L3

[21] Appl. No.: 498,646

[22] Filed: Mar. 26, 1990

[30] Foreign Application Priority Data

Sep. 29, 1989 [CA] Canada ..... 614487

[51] Int. Cl.[5] ..... H01R 33/97; H01R 13/44

[52] U.S. Cl. ..... 174/40 R; 248/552; 292/307 R; 439/304; 439/308

[58] Field of Search ..... 174/40 R, 41, 135; 70/57.1, 58, 174; 109/52; 248/551, 552, 553; 285/177; 292/307 R, 307 A, 307 B; 439/133, 134, 147, 304, 306, 308, 345, 366, 367, 373

[56] References Cited

U.S. PATENT DOCUMENTS

| | | | |
|---|---|---|---|
| 1,708,292 | 4/1929 | Buys | 174/92 |
| 2,033,371 | 3/1936 | Benaggio | 292/307 B |
| 3,422,281 | 1/1969 | Coston | 174/40 R X |
| 4,053,195 | 10/1977 | Laverick et al. | 439/308 |
| 4,477,948 | 10/1984 | Sachs | 24/115 R |
| 4,673,230 | 6/1987 | Baumgart | 439/304 X |

FOREIGN PATENT DOCUMENTS

| | | | |
|---|---|---|---|
| 982787 | 2/1976 | Canada . | |
| 1354173 | 1/1964 | France | 439/133 |
| 22028 | of 1895 | United Kingdom | 174/91 |

OTHER PUBLICATIONS

Two pages entitled "Aerial Can Trap Off Premise:Enclosures" from a brochure of Multilink, Elyria, Ohio.

*Primary Examiner*—Laramie E. Askin

*Attorney, Agent, or Firm*—Charles A. Brown

[57] ABSTRACT

A top shield arrangement for elongated filter traps, comprising an elongated sleeve member adapted to receive through one and thereof at least one filter trap such that the filter trap lies completely inside the sleeve member. The sleeve member is formed at the other end thereof for preventing withdrawal of the filter trap from the other end. A wafer seal is inserted into the sleeve member at the one end of the sleeve member for preventing unauthorized removal of the filter trap from the sleeve member through the one end thereof. The top shield arrangement of the invention protects filter traps against tampering by unauthorized persons.

15 Claims, 4 Drawing Sheets

TOP SHIELD ARRANGEMENT FOR FILTER TRAPS

BACKGROUND OF THE INVENTION

The invention relates to a top shield arrangement for protecting filter traps of cable television systems from tampering by unauthorized persons. More specifically, the invention relates to such an arrangement which includes security means for preventing such tampering and unauthorized removal of the filter from the arrangement.

It is well known that signals of cable television systems are delivered from the central station to the subscribers by cable. The cables are exposed in aerial installations or run along sidewalls of buildings to make their way to the subscribers.

Cable companies may provide a large number of services not all of which would be subscribed to by each subscriber. Thus, in addition to offering local channels, cable companies may also offer pay channels such as movie network, sports network, news network, etc. As all of these services are carried on the same cable, the services which are not paid for by a subscriber must be filtered out in the cable going to the subscriber. For this purpose, filter traps are placed in the line between the main trunk of the cable television system and the television set of the subscriber.

The filter traps are quite often unavoidably disposed in positions in which they can be accessed by unauthorized people. Thus, the filter traps are typically not disposed in the home of the subscriber where they could be easily tampered with by the subscriber. Instead, they are disposed in the out-of-doors environment where they could conceivably be tampered with by unauthorized persons.

SUMMARY OF THE INVENTION

It would thus be desirable to provide a means for protecting the filter traps from tampering by unauthorized persons.

It is therefore an object of the invention to provide such a means for protecting filter traps from tampering by unauthorized persons.

It is another object of the invention to provide a top shield arrangement for protecting such filter traps and preventing unauthorized tampering with the filter traps, while still permitting visual auditing from the ground.

It is a still further object of the invention to provide such top shields which have security means to prevent unauthorized tampering or removal of the filter trap from the top shield once the filter trap has been inserted into the top shield.

In its general principles, the top shield comprises an opening through which the filter trap may be inserted into the top shield, and security means to block the opening after the filter trap is in the top shield, whereby the filter trap cannot be easily removed from the top shield without evidence of tampering by unauthorized persons.

In accordance with one aspect of the invention, there is provided a top shield arrangement for elongated filter traps, comprising an elongated sleeve member adapted to receive through one end thereof at least one filter trap such that the filter trap lies completely inside the sleeve member; arresting means integral with the sleeve member at the other end thereof for preventing withdrawal of the filter trap from the other end; and security means at the one end of the sleeve member for preventing unauthorized removal of the filter trap from the sleeve member through the one end thereof.

Preferably, the sleeve member has a cylindrical configuration and merges at the other end with a coaxial neck of reduced diameter defining the above arresting means.

The present invention also provides, in another aspect thereof, a top shield arrangement for cylindrical filter traps, comprising an elongated sleeve member of cylindrical cross-section adapted to receive through one end thereof at least one filter trap such that the filter trap lies inside the sleeve member, the sleeve member merging at the other end thereof with a coaxial neck of reduced diameter defining arresting means for preventing withdrawal of the filter trap from the other end, the coaxial neck adapted to receive a cable with a connector element of cylindrical cross-section for connection to a mating threaded portion of the filter trap, and an integral transversely extending wall member arranged internally of the sleeve member adjacent the coaxial neck. The wall member is formed with an opening for receiving therethrough the threaded portion of the filter trap, the opening having a diameter smaller than the diameter of the connector element whereby the wall member together with the coaxial neck prevent unauthorized removal of the filter trap from the sleeve member when the connector element is connected to the threaded portion of the filter trap.

In the case where the filter trap is connected at one end thereof to a terminal of a multitap directional coupler and, at the other end, to the cable, the sleeve member advantageously has a length such as to substantially completely encase the filter trap.

On the other hand, in the case where the filter trap is connected at one end thereof to one cable and, at the other end, to another cable, two sleeve members are advantageously arranged end-to-end in axial alignment with the necks thereof extending in opposite directions, the sleeve members each having a length such that, when disposed in the said axial alignment, the sleeve members substantially completely encase the filter trap.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
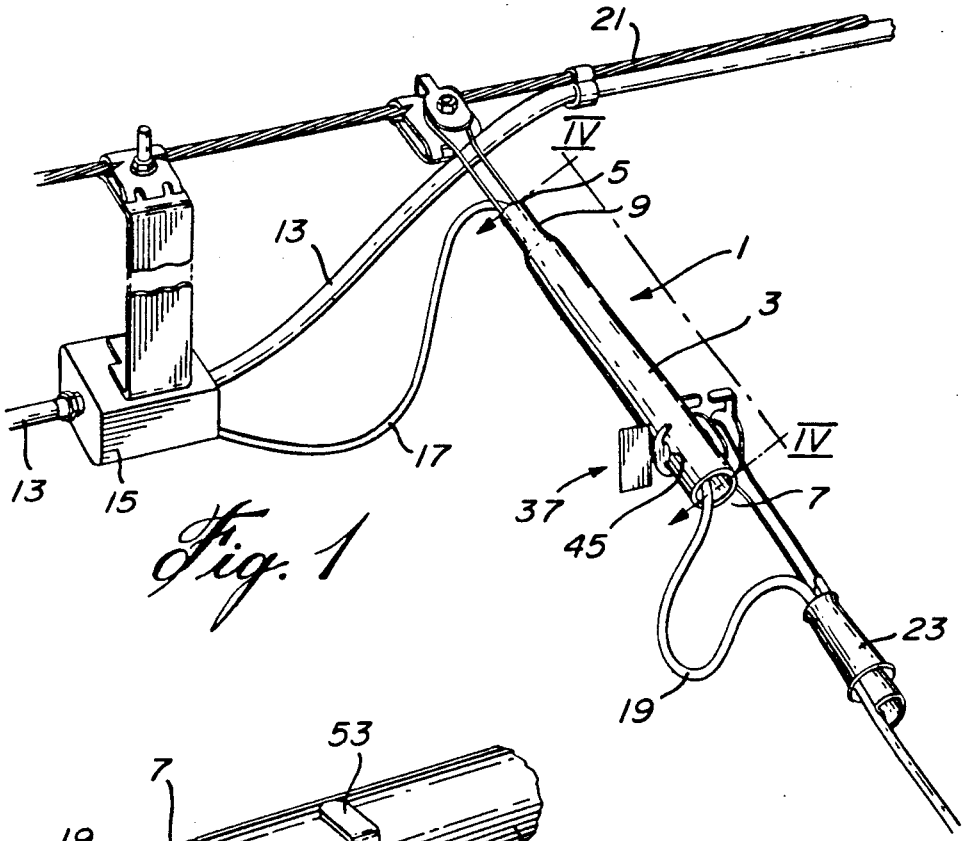
FIG. 1 illustrates a top shield according to a preferred embodiment of the invention, disposed in an aerial arrangement of television cable.

Referring first to FIG. 1, a top shield for enclosing filter traps is illustrated generally at 1 and includes an elongated sleeve member 3 of circular cross-section, into which a plurality of series-connected filter traps 11 are inserted. The sleeve member 3 has a first end 5 and a second end 7. The first end is merged into a coaxial neck 9 of reduced diameter. Although a neck is shown to reduce the diameter, it is well known that other means could be used, e.g., a flange across the opening wherein the flange has an opening of reduced diameter.

Figure 4:
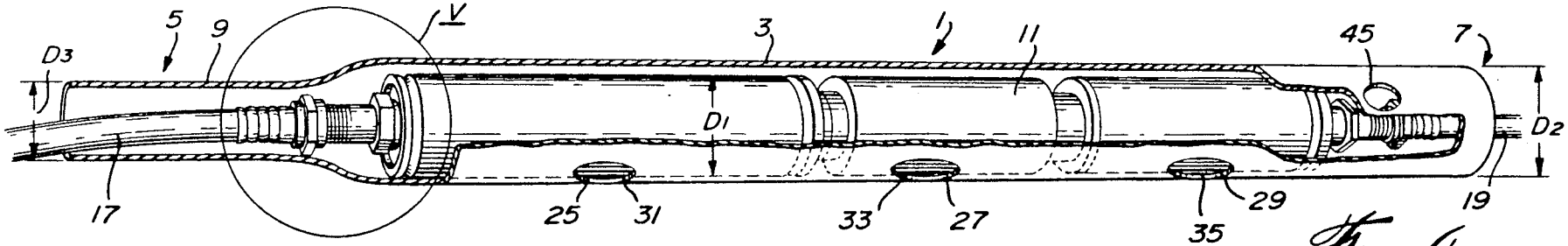
FIG. 4 is a section through IV—IV of FIG. 1.

As seen in FIG. 4, each filter trap 11 has a diameter D1. The diameter D3 of the neck 9 is less than D1, and the diameter D2, at the second end of the cylindrical member 3, is greater than D1. Thus, filter traps 11 can be inserted into the sleeve member 3 through the second end 7, but cannot be withdrawn through the first end 5.

Returning to FIG. 1, a trunk cable 13 of a cable television system is fed into an input terminal of multitap directional coupler 15. The trunk cable 13 emerges from one of the output terminals of the coupler, and a second local cable 17 is connected to a second output terminal of the multitap directional coupler. As seen in FIG. 4, the local cable 17 is connected to one end of the series-connected filter traps 11, and a subscriber cable 19 is connected to the other end of the series-connected filter traps. The trunk cable 13 is carried by strand 21 to other subscribers, and the subscriber cable 19 after going through a loop is passed through a drop clamp 23 on its way to the subscriber television set.

Figure 6:
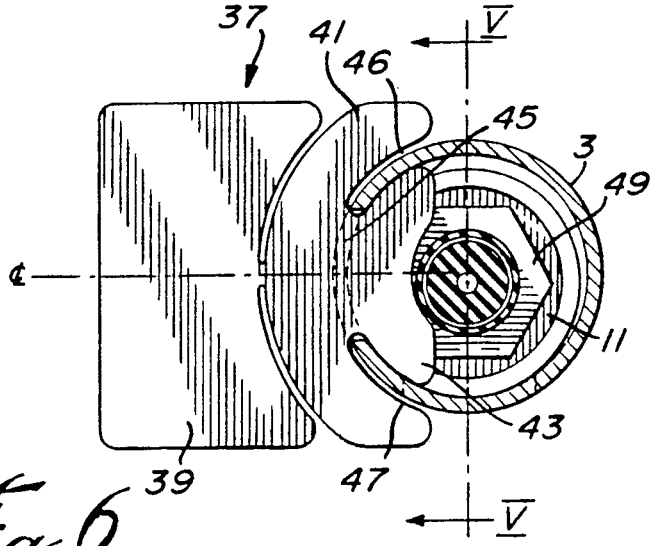
FIG. 6 is a section through VI—VI of FIG. 5 showing in greater detail the security means of the FIG. 5 embodiment.

Returning to FIG. 4, the sleeve member 3 includes openings 25, 27 and 29 to display colour codes 31, 33 and 35 of the filter traps, thereby facilitating visual auditing. A security seal 37 is placed adjacent the second end 7 of the sleeve member 3 as shown in FIG. 1. Referring to FIG. 6, a particular embodiment of the security seal 37 comprises a wafer-like member having a break-way or tamper-evident tab 39, a wing-shaped external retainer 41, and a butterfly-shaped internal retainer 43. As can be seen, the break-away tab 39 is only weakly coupled to the external retainer 41 so that if there is any attempted tampering with the security seal 37, the break-away tab 39 will break away. Thus, by simple visual inspection, it is possible to see when there has been an attempt at tampering with the security seal 37.

Returning to FIG. 6, the external retainer 41 is separated from the internal retainer 43 by arced slots 46 and 47. The arc of the arced slots has a radius equal to the radius of the sleeve member 3, and the slots 46,47 are wide enough to receive the wall of the sleeve member as seen in FIG. 6.

Figure 5:
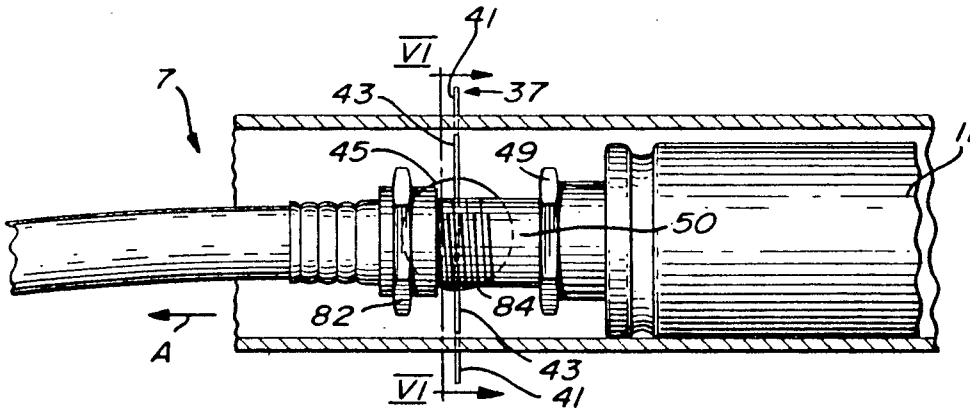
FIG. 5 is an expansion of the portion designated V in FIG. 4, FIG. 5 also illustrating one embodiment of a security seal in accordance with the invention.

With this arrangement, if an unauthorized person attempts to remove any of the filter traps 11 through the second end 7 by moving it in the direction of the arrow A as illustrated in FIG. 5, then the hexagonal part 49 of the adaptor 50 connected to the filter trap 11 will abut the internal butterfly-shaped retainer 43 to prevent further movement in the direction A of the filter trap 11. Accordingly, the filter trap cannot be withdrawn from the second end 7 of the member 3 when the security seal 37 in accordance with the illustrations in FIGS. 5 and 6 is inserted in the security opening 45 of the sleeve member at the second end thereof.

The wafer-like security seal 37 of FIG. 6 preferably comprises a plastic material which is easily bendable about its center line CL. To insert the wafer-like seal in the security opening 45 of the sleeve member 3, the wafer-like seal is bent about its center line and the internal retainer 43 inserted into the opening 45 of the sleeve member 3 (see FIGS. 5 and 6). The wafer-like seal is then released so as to cause the butterfly-shaped internal retainer 43 to spring back into its original configuration to thereby lockingly engage with the inner surface of the wall of the sleeve member 3, as illustrated in FIG. 6.

Figure 2:
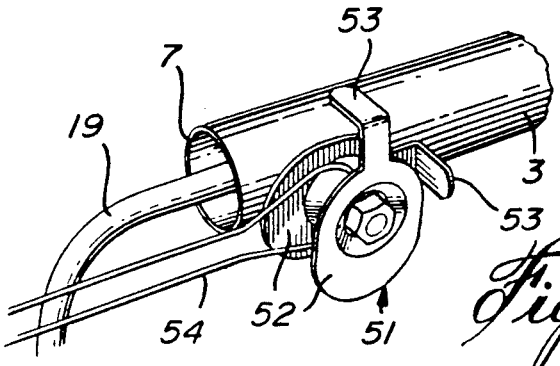
FIG. 2 illustrates further elements needed when the aerial installation of FIG. 1 comprises a non-messenger drop cable.

FIG. 2 illustrates the aerial installation of FIG. 1 with a non-messenger drop cable. Omni-directional hook 51 comprising two retainer rings 52 each having a retainer tab 53 is mounted on the sleeve member 3, and a looped wire 54 is attached to, for example, a drop clamp as illustrated at 23 in FIG. 1. Once again, the subscriber cable will enter into the drop clamp 23 after passing through the loop. It then continues onto the television set of the subscriber.

Figure 3:
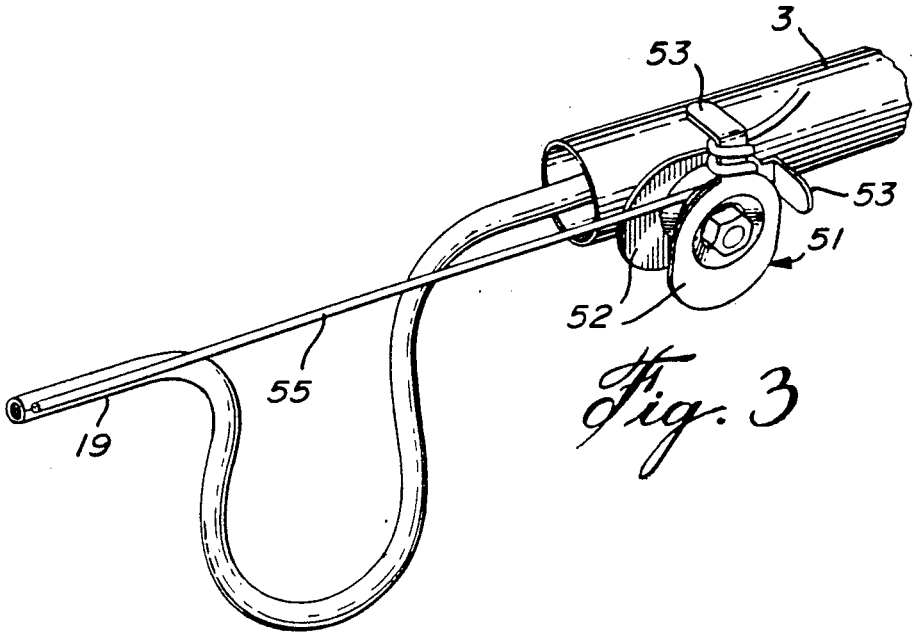
FIG. 3 illustrates additional elements needed when the aerial installation of FIG. 1 comprises a messenger drop cable.

FIG. 3 illustrates an aerial installation with a messenger drop cable 19,55. The messenger steel wire 55 which is integral with the cable 19 is well known in the art and is used to support the subscriber cable 19. The messenger wire 55 is attached, at one end thereof, as by wrapping, to the omni-directional house hook 51, between the retainer rings 52 and terminating one end around the tab 53.

Figure 7:
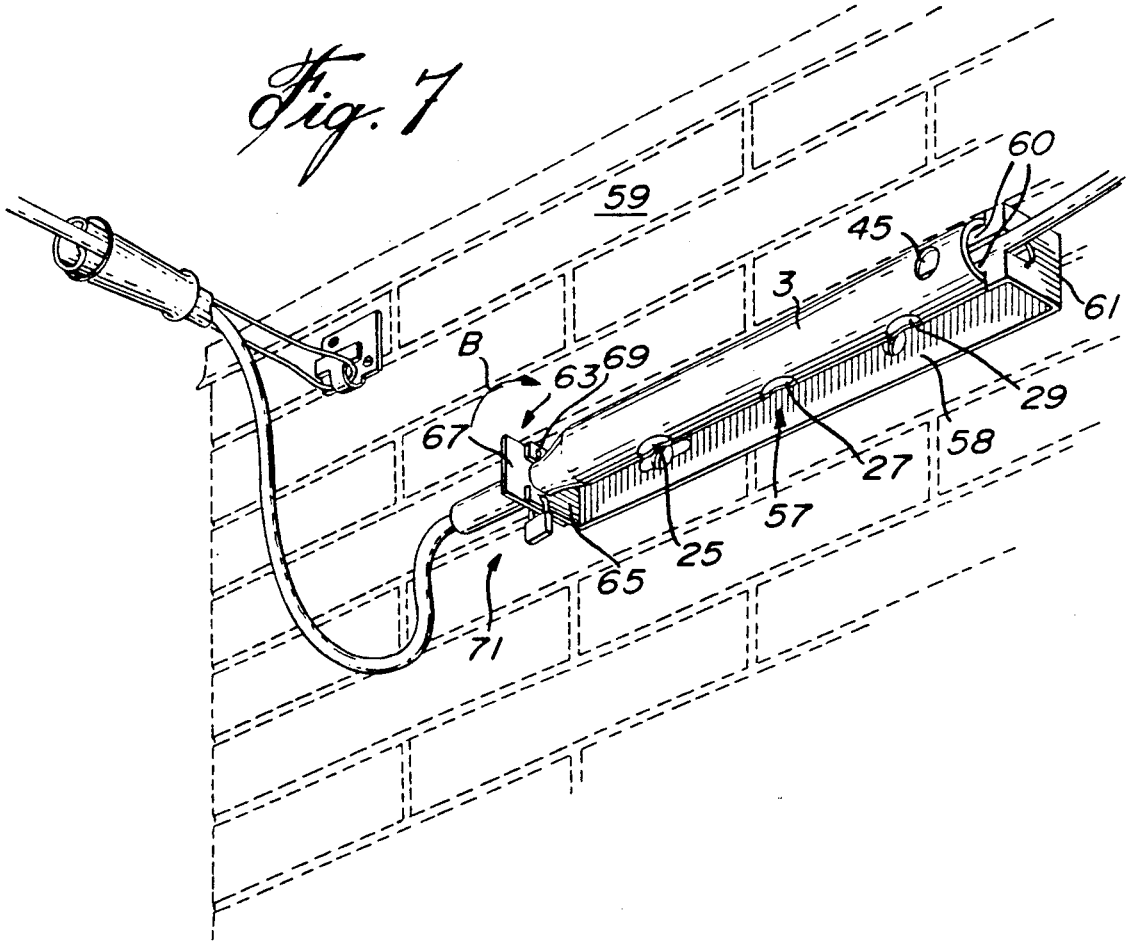
FIG. 7 illustrates a wall-mounted top shield using a different security means than the security means shown in FIG. 6.

FIG. 7 illustrates a wall mounting arrangement in accordance with the invention. In FIG. 7, a wall bracket 57 comprises a wall mounting portion 58 which is mounted on a wall 59 as by screw means or the like. A first member 61 extends at right angles to the wall mounting portion 58 at the rear end of the sleeve member 3 and includes a pair of spaced-apart transverse projections 60, and a second member 63 extends at right angles from the wall mounting portion 58 at the front end of the sleeve member 3. The projections 60 of the member 61 block the opening at the rear end of the sleeve member 3 so that, once again, the filter trap inserted in the top shield and encased by the top shield cannot be removed from the top shield nor can it be tampered with.

As an additional security feature, the member 63 comprises a fixed lower element 65 and a pivoting upper element 67. The pivoting element 67 pivots relative to the fixed element 65 about a pivot point 69 in the direction of the arrow B.

To install the sleeve member 3, the pivoting element 67 is pivoted in the direction of arrow B away from the fixed element 65 and the sleeve member is installed as shown in FIG. 7. The pivoting element 67 is then pivoted back into the position as shown in FIG. 7. The pivoting element 67 is locked to the fixed element 65 by a lock 71. For this purpose, elements 65 and 67 will have aligned openings through which the U-shaped part of the lock can extend.

Figures 8, 9, 10:
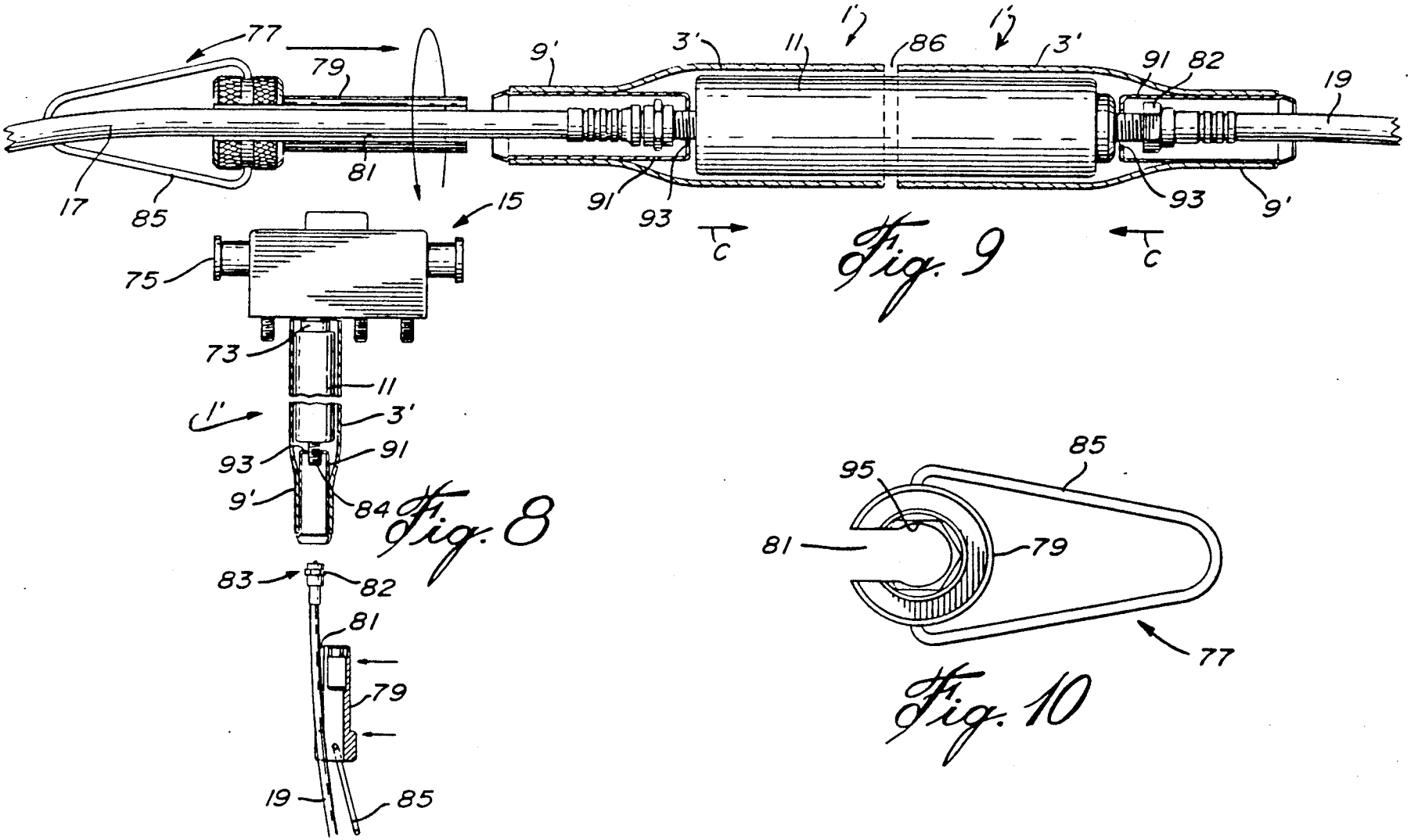
FIG. 8 illustrates another preferred embodiment of the invention.
FIG. 9 shows an alternate way of connecting the embodiment illustrated in FIG. 8.
FIG. 10 illustrates a feature of the tool used in the FIG. 8 and FIG. 9 embodiments.

FIG. 8 illustrates an alternate approach for connecting a top shield 1', having a different structure, to the multitap directional coupler 15 of FIG. 1. Referring to FIG. 8, one end of the filter trap 11 is connected to a terminal 73 comprising an output terminal of the multitap directional coupler 15 and sleeve member 3' of top shield 1' encases the filter trap 11. Trunk cable 13 is connected to terminal 75.

Cylindrical retainer 91, inserted into neck 9', has an integral circular flange 93 defining a transversely extending apertured wall. When the cable 19 is screwed onto the filter trap as shown in FIG. 9, as well known in the art, nut 82 of the connector 83 will abut against the flange 93 when it is attempted to move filter trap 11 in the direction of arrow C, so that filter trap 11 cannot be withdrawn from sleeve member 3'.

A special tool 77 is needed to connect the connector 83 of cable 19 to the filter trap 11 inside the sleeve member 3'. The tool is illustrated in FIGS. 8, 9 and 10. As can be seen, the tool comprises a cylindrical portion 79 having a slot 81 for receiving cable 19. As seen in FIG. 10, the free end of the tool comprises a hexagonal shape 95 and is of a correct size to engage hexagonal nut 82 of the connector 83. Thus, the nut can be rotated to screw the connector 83 of the coaxial cable 19 onto a mating threaded portion 84 of the filter trap 11.

The tool also includes a looped wire 85 for carrying purposes.

In an alternate embodiment, as illustrated in FIG. 9, the safety arrangement comprises two sleeve members 3' arranged end-to-end in axial alignment and spaced by a gap 86. Once again, the tool 77 is needed to connect the coaxial cables 17 and 19 respectively to respective ends of the filter trap 11. Flanges 93 together with the necks 9' will prevent the filter trap 11 from being removed from the sleeve members 3', therefore prohibiting unauthorized access to the filter trap 11.

Although several embodiments have been described, this was for the purpose of illustrating, but not limiting, the invention. Various modifications, which will come readily to the mind of one skilled in the art, are within the scope of the invention as defined in the appended claims.

I claim:

1. A top shield arrangement for elongated filter traps, comprising:

an elongated sleeve member adapted to receive through one end thereof at least one filter trap such that the filter trap lies completely inside said sleeve member;

arresting means integral with said sleeve member a the other end thereof for preventing withdrawal of said filter trap from said other end; and security means at said one end of preventing unauthorized removal of said filter trap from said sleeve member through said one end;

said security means comprising tamper evident means comprising an external detachable breakaway member and an internal retainer member;

whereby, detachment of said breakaway member indicates tempering; and said internal retainer member prevents unauthorized removal of said filter trap from said sleeve member both when said breakaway member is not detached and when said breakaway member is detached.

2. A top shield arrangement as claimed in claim 1, wherein said sleeve member has a cylindrical configuration and merges at said other end with a coaxial neck of reduced diameter defining said arresting means.

3. A top shield arrangement as claimed in claim 1, wherein said sleeve member is formed with at least one opening for displaying color coding of said filter trap.

4. A top shield arrangement as claimed in claim 1, wherein said detachable breakaway member and said internal retainer member comprise a wafer-like seal arrangement and wherein said sleeve member includes a security opening for receiving said wafer-like seal arrangement.

5. A top shield arrangement for elongated filter traps, comprising:

an elongated sleeve member adapted to receive through one end thereof at least one filter trap such that the filter trap lies completely inside said sleeve member;

arresting means integral with said sleeve member at the other end thereof for preventing withdrawal of said filter trap form said other end; and security means comprising a wafer-like seal arrangement at said one end for preventing unauthorized removal of said filter trap from said sleeve member through said one end;

wherein said sleeve member has a cylindrical configuration with a predetermined diameter and wherein said wafer-like seal arrangement includes:

a tamper evident break-away tab;

a wing-shaped external retainer weakly connected to said break-away tab;

a butterfly-shaped internal retainer connected to said external retainer;

arced slots being defined between said internal retainer and said external retainer, the arc of said slots having a radius corresponding to the diameter of said sleeve member, said slots being wide enough to receive the wall of said sleeve member such that said internal retainer is disposed internally of said sleeve member at said one end thereof and lockingly engages with said wall to thereby prevent said filter trap from being withdrawn from said one end of said sleeve member.

6. A top shield arrangement for elongated filter traps for wall mounting, comprising:

an elongated sleeve member adapted to receive through one end thereof at least one filter trap such that the filter trap lies completely inside said sleeve member;

arresting means integral with said sleeve member at the other end thereof for preventing withdrawal of said filter trap form said other end; and security means at said one end for preventing unauthorized removal of said filter trap form said sleeve member through said one end;

a wall bracket comprising an elongated wall mounting portion for mounting on a wall, a first member extending at a right angle to said wall mounting portion at one end thereof and a second member extending at a right angle to said wall mounting portion at the other end thereof;

said sleeve member being received in said wall bracket between said first and second members thereof such that said first member is disposed adjacent said one end of said sleeve member, said first member defining said security means.

7. A top shield arrangement as claimed in claim 6 wherein said first member includes a pair of spaced apart transverse projections;

said projections extending into said one end of said sleeve member.

8. A top shield arrangement as claimed in claim 7 and further including locking means for lockingly securing said sleeve member at the other end thereof to said second member.

9. A top shield arrangement as claimed in claim 8, wherein said sleeve member has a cylindrical configuration and merges at said other end with a coaxial neck of reduced diameter defining said arresting means, and wherein said second member comprises a fixed element and a pivoting element adapted to receive said neck therebetween, said pivoting element being pivotable relative to said fixed element and being locked thereto by said locking means when said neck is disposed between said fixed and pivoting elements.

10. A top shield arrangement for cylindrical filter traps, comprising an elongated sleeve member of cylindrical cross-section adapted to receive through one end thereof at least one filter trap such that the filter trap lies inside said sleeve member, said sleeve member merging at the other end thereof with a coaxial neck of reduced diameter defining arresting means for preventing withdrawal of said filter trap from said other end, said coaxial neck adapted to receive a cable with a connector element of cylindrical cross-section for connection to a mating threaded portion of said filter trap, and an integral transversely extending wall member arranged internally of said sleeve member adjacent said coaxial neck, said wall member being formed with an opening for receiving therethrough the threaded portion of said filter trap, said opening having a diameter smaller than the diameter of said connector element whereby said wall member together with said coaxial neck prevent unauthorized removal of said filter trap from said sleeve member when said connector element is connected to the threaded portion of said filter trap.

11. A top shield arrangement as claimed in claim 10, wherein said filter trap is connected at one end thereof to a terminal of a multitap directional coupler and, at the other end, to said cable, and wherein said sleeve member has a length such as to substantially completely encase said filter trap.

12. A top shield arrangement as claimed in claim 10, wherein said filter trap is connected at one end thereof to said cable and, at the other end, to another cable, and wherein two sleeve members are arranged end-to-end in axial alignment with the necks thereof extending in opposite directions, said sleeve members each having a length such that, when disposed in said axial alignment, said sleeve members substantially completely encase said filter trap.

13. A top shield arrangement for elongated filter traps, comprising:

an elongated sleeve member extending along a longitudinal axis and adapted to receive through one end thereof at least one filter trap such that the filter trap lies completely inside said sleeve member;

arresting means integral with said sleeve member at the other end thereof for preventing withdrawal of said filter trap from said other end;

security means at said one end for preventing unauthorized removal of said filter trap from said sleeve member through said one end; and means for attaching said sleeve member to a support means such that said sleeve member is spaced from said support means by a predetermined distance and such that said sleeve member extends in a direction away from said support means.

14. A top shield arrangement as claimed in claim 13 wherein said attaching means comprises an elongate hooking member extending from said other end of said sleeve member and outwardly thereof and substantially along the longitudinal axis of said sleeve member.

15. A top shield arrangement as claimed in claim 14 wherein said hooking member consists of a metallic wire bent to define a hooking loop and having the free ends thereof secured to said other end of said sleeve member.

* * * * *